United States Patent [19]

Horii et al.

[11] Patent Number: 5,009,528

[45] Date of Patent: Apr. 23, 1991

[54] DOT PRINT HEAD

[75] Inventors: Masami Horii; Shigeo Komakine; Kuniaki Ochiai; Takashi Kondoh, all of Shizuoka, Japan

[73] Assignee: Tokyo Electric Co., Ltd., Tokyo, Japan

[21] Appl. No.: 357,901

[22] Filed: May 26, 1989

[30] Foreign Application Priority Data

| | | | |
|---|---|---|---|
| May 27, 1988 | [JP] | Japan | 63-130001 |
| Nov. 4, 1988 | [JP] | Japan | 63-279093 |
| Apr. 7, 1989 | [JP] | Japan | 1-89122 |

[51] Int. Cl.[5] ..... B41J 2/235

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,230,412 | 10/1980 | Hebert | 400/124 |
| 4,437,775 | 3/1984 | Ochiai et al. | 400/124 |
| 4,537,520 | 8/1985 | Ochiai et al. | 400/124 |
| 4,583,871 | 4/1986 | Ochiai et al. | 400/124 |
| 4,594,010 | 6/1986 | Jachno | 400/124 |
| 4,618,277 | 10/1986 | Asano | 400/124 |
| 4,624,589 | 11/1986 | Ochiai et al. | 400/124 |
| 4,634,301 | 1/1987 | Sakaida et al. | 400/124 |
| 4,652,158 | 3/1987 | Asano | 400/124 |

FOREIGN PATENT DOCUMENTS

| | | | |
|---|---|---|---|
| 0201669 | 12/1982 | Japan | 400/124 |
| 61-270164 | 11/1986 | Japan . | |
| 61-291150 | 12/1986 | Japan . | |
| 63-23041 | 2/1988 | Japan . | |
| 1539661 | 1/1979 | United Kingdom . | |

*Primary Examiner*—Edgar S. Burr
*Assistant Examiner*—C. A. Bennett
*Attorney, Agent, or Firm*—Oblon, Spivak, McClelland, Maier & Neustadt

[57] ABSTRACT

A dot print head comprising a yoke, a plurality of cores formed integrally with the yoke in an annular arrangement in the peripheral portion of the yoke, solenoid coils wound respectively around the cores, armatures fixedly provided respectively with styluses, an armature support supporting each armature at the middle portion thereof opposite to the corresponding core for swing motion, and an armature holding member disposed opposite to the yoke with a predetermined gap therebetween to hold the armatures on the armature support for swing motion. A plurality of joining parts are formed on the yoke on a line on which the cores are arranged, and a plurality of joining parts are formed on the armature holding member so as to be joined respectively to the connecting parts of the yoke in joining together the yoke and the armature holding member.

2 Claims, 5 Drawing Sheets

DOT PRINT HEAD

FIELD OF THE INVENTION AND RELATED ART STATEMENT

The present invention relates to an impact dot printer using a plurality of styluses.

Recently, there has been strong demand for dot print heads having a compact construction, capable of high speed printing operation and capable of saving power. The positional relation between a core placed in a solenoid coil and an armature fixedly provided with a stylus is a significant factor influencing the characteristics of the dot print head.

A dot print head of a first type comprises an armature having one end fixedly provided with a stylus and the other end, i.e., the rear end, supported pivotally so that the armature is able to swing on the rear end thereof, and a core disposed opposite the middle portion of the armature. A dot print head of a second type comprises an armature having one end fixedly provided with a stylus and supported pivotally for swing motion at the middle portion between the opposite ends thereof, and a core disposed opposite the other end, i.e., the rear end, of the armature.

The dot print head of the second type is able to operate at a high printing speed higher than that of the dot print head of the first type, because the moment of inertia of the armature is smaller than that of the armature of the dot print head of the first type. When the cores of the dot print head of the second type are arranged on a circle along the periphery of the dot print head, the contact surface of each armature to be brought into contact with the corresponding core is increased and thereby power consumption is reduced, and the cores can be arranged on a circle having a reduced diameter to reduce the size of the dot print head when the contact area of the armatures is not changed. Accordingly, the dot print head of the second type is advantageous over that of the first type in respect of forming the dot print head in a compact construction, increasing the printing speed and saving power. Such dot print heads of the second type are shown in FIGS. 6 and 7.

The dot print head shown in FIG. 6 is disclosed in Japanese Patent Publication No. 55-500160. The dot print head comprises a yoke 100, a plurality of cores 101 formed in the periphery of the yoke 100 in a circular arrangement, an armature support 102 formed along and inside the arrangement of the cores 101, armatures 104 each supported at the middle portion thereof on the armature support 102, a holding member 105 provided with an annular elastic member 106 for pressing the armatures 104 against the armature support 102, solenoid coils 108 wound respectively around the cores 101, springs 107 respectively engaging the front ends of the armatures 104 to bias the armatures 104 so that the rear ends of the armatures 104 are separated from the corresponding cores 101, a stopper holder 109 fitted in a hole formed in the central portion of the yoke 100, a rubber stopper 110 supported on the stopper holder 109 to define the respective return positions of the armatures 104, and a bolt 111 inserted through a center bore formed through the stopper holder 109 and screwed in an internally threaded hole formed in the central portion of the holding member 105 to join the yoke 100 and the holding member 105. When the solenoid coil 108 is energized, the rear end of the armature 104 is attracted to the core 101, so that the armature 104 is turned on the armature support 102 to advance the stylus 103 toward a platen.

The rear ends of the styluses 103 are arranged inevitably on a comparatively large circle since the yoke 100 and the holding member 105 are joined together at the respective central portions thereof with the bolt 111 and, on the other hand, the front ends of the styluses 103 must be arranged in a high density. Consequently, the styluses 103 are extended inevitably in a comparatively large bend and hence a comparatively large stress is induced in the styluses 103 when moved by the armatures 104 relative to a stylus guide 120. Repetitive exposure of the styluses 103 to such a large stress reduces the life of the styluses 103. Practically, the length of the styluses 103 is increased to extend the styluses in a comparatively small bend, which, however, increases the weight of the styluses 103 reducing the printing speed and increasing the power consumption of the dot print head. Furthermore, since the rear end of the styluses 103 are arranged on a comparatively large circle, the diameter of the circle on which the cores 101 are arranged is increased accordingly, which increases the overall size of the dot print head.

Still further, in joining the yoke 100 and the holding member 105 with the single bolt 111, it is difficult to fasten the yoke 100 to the holding member 105 simultaneously pressing the armatures 104 against the supporting ridge 115 of the armature support 102 with the elastic member 106 by an appropriate pressure and compressing a spring washer 114 placed between the outer surface of the yoke 100 and the flange of the stopper holder 109 by an appropriate pressure, so that it is difficult to secure the armatures 104 for stable operation.

This dot print head has a further disadvantage that the yoke 100 and the solenoid coils 108 must be covered with a protective cover formed of a synthetic resin or the like to protect the operator from heat in operating the dot print head for changing the ink ribbon or the like, because the solenoid coils 108 generates heat when energized, part of the heat generated by the solenoid coils 108 is transferred to the carriage, not shown, through the yoke 100 and the rest of the heat heats the solenoid coils 108, which requires additional space for the protective cover and increases the size of the dot print head. When the dot Print head is mounted on the carriage with the yoke 100, which is opposite the styluses 103, attached to the carriage, dispersion in the bend of the styluses causes a large irregularity in the arrangement of the points of the styluses. Therefore, the dot print head must be provided with an adjusting mechanism for adjusting the respective printing positions of the points of the styluses even if the dimensional accuracy of a portion of the yoke 100 to be attached to the carriage is enhanced, which increases the cost of the dot print head.

A dot print head shown in FIG. 7 comprises a yoke 112, a plurality of cores 114 arranged on the yoke 112 in a circular arrangement, solenoid coils 113 wound respectively around the cores 114, an armature support 115 disposed along and inside the arrangement of the cores 114, armatures 117 each supported swingably at the middle portion thereof on the armature support 115, an armature holding member 116 for swingably holding the armatures 117 on the armature support 115, an elastic armature pressing member 118 provided on the armature holding member 116 to press the armatures 117 elastically against the armature support 115, styluses 119 fixed respectively to the front ends of the armatures 117, a stylus guide 120 for regularly arranging the free ends of the styluses 119 and guiding the styluses 119 for sliding motion, a cover 122 covering the yoke 112 coated with a resin 121, and a plurality of bolts 123 fastening the periphery of the cover 122 to the periphery of the armature holding member 116. The solenoid coil 113 is energized to attract the rear end of the armature 117 to the core 114 so that the armature 117 is turned on the armature support 115 to advance the stylus 119 toward a platen.

This dot print head needs the cover 122 additionally to join the yoke 112 to the armature holding member 116 and the cover 122 increases the overall size of the dot print head. Furthermore, in manufacturing the dot print head, the component parts must be subjected to an additional grinding process to finish the end surfaces of the cores 114 and the armature support 115 in a predetermined dimensional relation with the end surface of the cover 122 to be joined to the armature holding member 116, which increases the manufacturing cost.

Still further, the cover must be formed in a comparatively large size to cover the resin-coated assembly of the yoke 112, the solenoid coils 113 and the cores 114. Moreover, the cover 122 must be formed of a metal having a high heat conductivity to enable the cover 122 transfer heat generated by the solenoid coils 113 efficiently to the atmosphere. However, the cover 122 is heated to a high temperature when the dot print head is operated for a long time, and there is the possibility of the operator touching the hot cover 122 when the operator approaches the dot print head, for example, to change the ink ribbon after opening the casing of the dot printer. Covering the cover 122 with another cover further increases the size of the dot print head.

OBJECT AND SUMMARY OF THE INVENTION

Accordingly, it is a first object of the present invention to provide a dot print head having styluses arranged in a comparatively small bend and having a comparatively small length and a comparatively small weight, and capable of operating at a high printing speed.

It is a second object of the present invention to provide a dot print head having armatures having a comparatively small moment of inertia.

It is a third object of the present invention to provide a dot print head eliminating thermal danger.

It is a fourth object of the present invention to provide a dot print head having armatures the stroke of which can be easily adjusted.

In one aspect of the present invention, a dot print head comprises a yoke; a plurality of cores formed in a circular arrangement along the periphery of the yoke; solenoid coils wound respectively around the cores; armatures each fixedly provided with a stylus at the front end thereof; an armature support for supporting the armature at the middle portion thereof for swing motion thereon, formed on the yoke along and inside the arrangement of the cores; an armature holding member for swingably holding the armatures in place on the armature support, disposed opposite to the cores with a predetermined gap between the lower surface thereof and the end surfaces of the cores; and resilient members biasing the armatures so that the rear ends of the armatures are separated from the end surfaces of the corresponding cores; characterized in that a plurality of joining parts are formed in the yoke on the circle on which the yokes are arranged and in the armature holding member so as to correspond respectively to those formed in the yoke.

The disposition of the cores respectively opposite to the rear ends of the armatures increases the area of contact between the armature and the corresponding core and hence the armature can be attracted to the core by supplying a comparatively small power to the corresponding solenoid coil. Since the armatures are supported for swing motion each at the middle portion thereof, the moment of inertia of the armatures is comparatively small. The arrangement of the joining parts of the yoke on the circle on which the yokes are arranged enables the rear ends of the styluses to be arranged on a comparatively small circle, so that the styluses can be extended in a comparatively small bend and the styluses can be formed in a comparatively small length and a comparatively small weight, which effectively enables the dot print head to operate at a high printing speed. The direct connection of the yoke to the armature holding member eliminates additional parts for connecting the yoke to the armature holding member. Since the joining parts of the yoke, the cores and the armature support are formed in a single unit, the joining parts, the cores and the armature support can be positioned accurately relative to each other and a yoke grinding operation can be omitted.

BRIEF DESCRIPTION OF THE DRAWINGS

The above and other objects, features and advantages of the present invention will become more apparent from the following description taken in conjunction with the accompanying drawings in which.

DETAILED DESCRIPTION OF THE PREFERRED EMBODIMENTS

Figure 1:
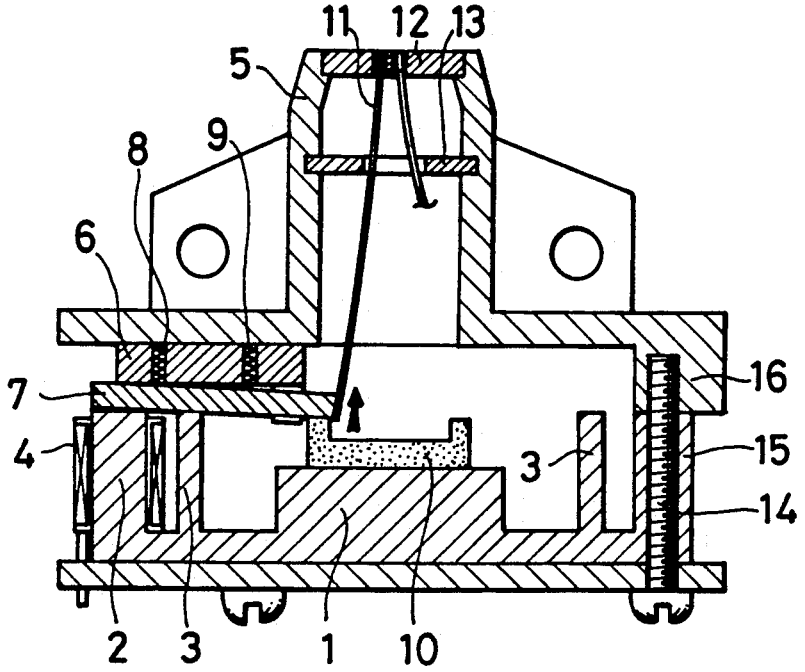
FIG. 1 is a longitudinal sectional view of a dot print head in a first embodiment according to the present invention.
Figure 2:
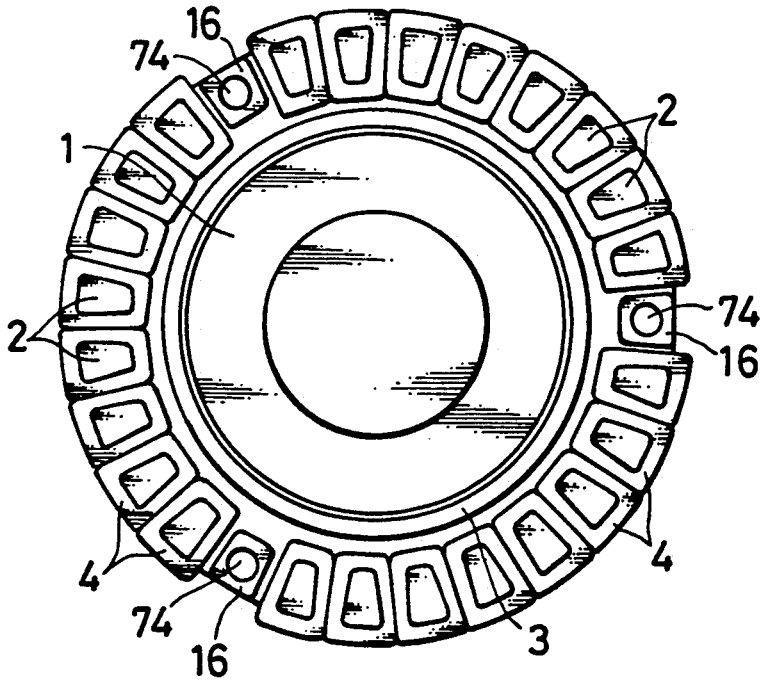
FIG. 2 is a plan view of a yoke employed in the dot print head of FIG. 1.

First Embodiment (FIGS. 1 and 2)

Referring to FIG. 1, a yoke 1, a plurality of cores 2 and an annular armature support 3 are formed integrally in a single unit. The cores 2 are arranged on a circle along the periphery of the yoke 1. The annular armature support 3 is formed along and inside the arrangement of the cores 2. Solenoid coils 4 are wound respectively around the cores 2. An armature holding member 5 is provided with an armature guide 6 for swingably holding a plurality of armatures 7, outer balancing springs 8 and inner balancing springs 9. The armatures 7 are pressed against the armature support 3 by means of the outer balancing springs 8 and the inner balancing springs 9. The pressure applied to the armature 7 by the inner balancing spring 9 is greater than that applied to the same by the outer balancing spring 8, so that the armature 7 is separated from the end surface of the corresponding core 2 and is held at a predetermined return position by an armature stopper 10 fixed to the central portion of the inner surface of the yoke 1. A stylus 11 is fixed to the front end of each armature 7 by brazing. Stylus guide chips 12 and 13 for slidably guiding the styluses 7 in a predetermined arrangement are fixed to the nose of the armature holding member 5.

The yoke 1 is provided integrally with a plurality of joining parts 15 arranged on the circle on which the cores 2 are arranged. The armature holding member 5 is provided integrally with a plurality of joining parts 16 arranged so as to correspond respectively to the joining parts 15 of the yoke 1. The end surfaces of the joining parts 15 to be in contact respectively with the end surfaces of the joining parts of the armature holding member 5, the end surfaces of the cores 2 and the end surface of the armature support 3 are flush with each other.

When the solenoid coil 4 is energized, the rear end of the armature 7 is attracted to the core 2 and the armature 7 turns on the armature support 3 to advance the stylus 11 toward a platen. While the solenoid coil 4 is not energized, the armature 7 is turned in the opposite direction by the inner balancing spring 9 to the return position defined by the armature stopper 10.

Since the cores 2 are arranged outside the armature support 3, the rear end of each armature 7 can be brought into contact with the end surface of the core 2 with a large contact area. Accordingly, the armature 7 can be attracted to the core 2 by supplying a comparatively small current to the solenoid 4. The moment of inertia of the armature 7 is comparatively small because the armature 7 is disposed with the rear end thereof opposite the core 2. Since the yoke 1 and the armature holding member 5 are joined together with bolts 14 along the respective peripheries thereof, the rear ends of the styluses 11 can be arranged on a circle of a comparatively small diameter, and hence the styluses having a comparatively small length and a comparatively small weight are extended in a small bend, which effectively increases the printing speed of the dot print head. Since the joining parts 15 of the yoke 1 are arranged on the circle on which the cores 2 are arranged and the joining parts 16 of the armature holding member 5 are arranged along the periphery of the armature holding member 5 at positions corresponding respectively to the joining parts 15 of the yoke 1, the respective diameters of the yoke 1 and the armature holding member 5 are comparatively small.

The direct attachment of the armature holding member 5 to the yoke 1 with the bolts 14 eliminates additional parts for joining together the yoke 1 and the armature holding member 5. Since the joining parts 15, the cores 2 and the armature support 3 and the yoke 1 are formed integrally in a single unit, the joining parts 15, the cores 2 and the armature support 3 can be disposed accurately relative to each other on the yoke 1 with a comparatively small dimensional tolerance, and a process of grinding the yoke 1 to dispose the joining parts 15, the cores 2 and the armature support 3 accurately relative to each other can be omitted. Particularly, forming the cores 2, the armature support 3, and the joining parts 15 of the yoke 1 with the respective end surfaces thereof in flush with each other enables the cores 2, the armature support 3 and the joining parts 15 to be positioned accurately relative to each other. Accordingly, the cores 2 and the armatures 7 can be disposed with an accurate gap therebetween when the yoke 1 and the armature holding member 5 are joined together. Furthermore, the yoke 1 need not be covered with such a cover as employed in the conventional dot print head shown in FIG. 4, which curtails the manufacturing cost.

The cores 2 need not necessarily be disposed in a circular arrangement as shown in FIG. 2, but may be disposed in an elliptical arrangement or a polygonal arrangement.

Figure 3:
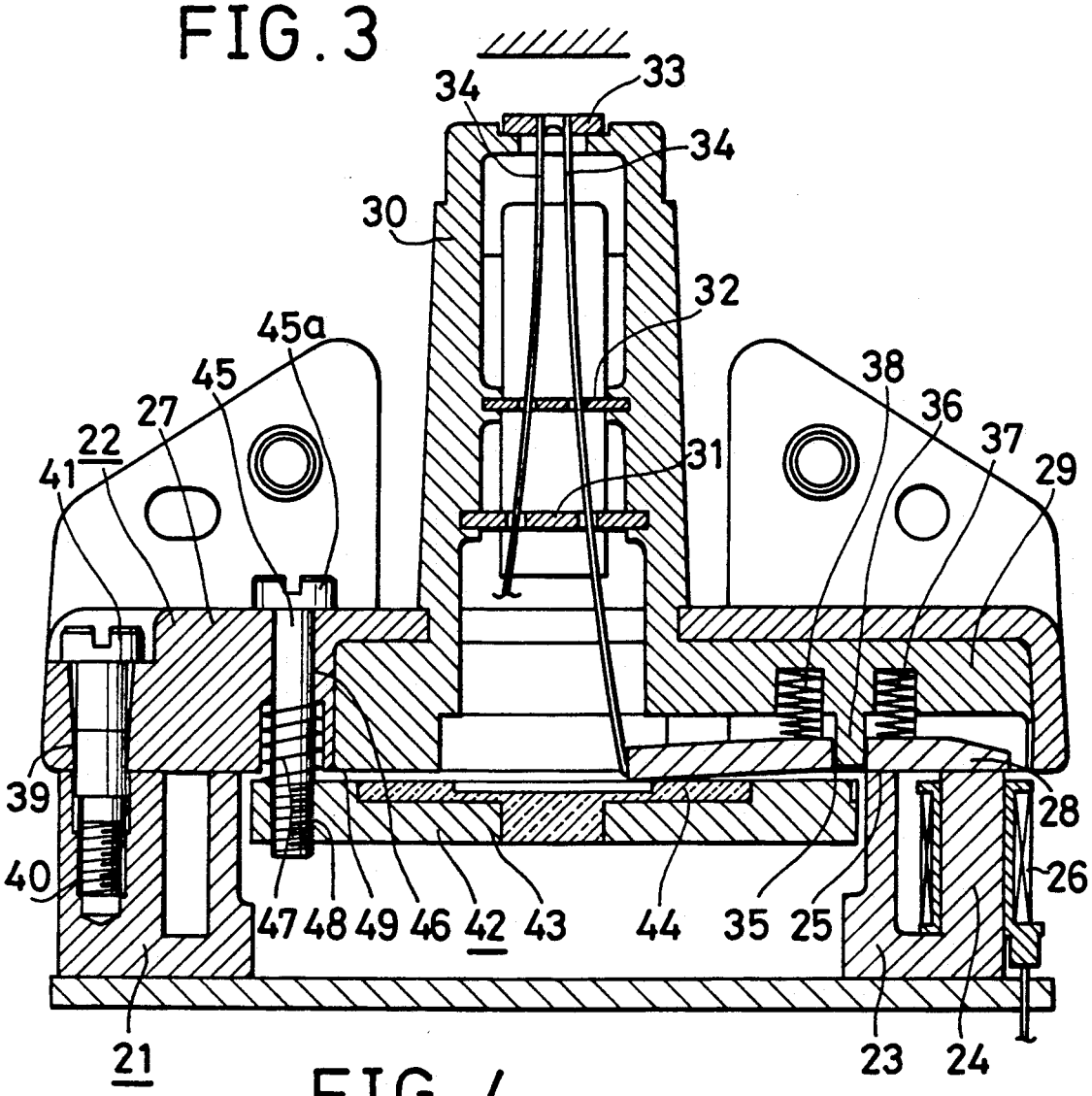
FIG. 3 is a longitudinal sectional view of a dot print head in a second embodiment according to the present invention.
Figure 4:
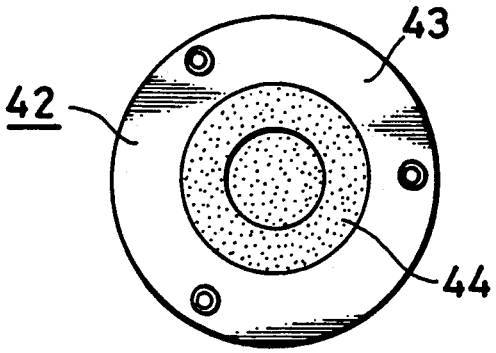
FIG. 4 is a contracted plan view of an armature stopper employed in the dot print head of FIG. 3.

Second Embodiment (FIGS. 3 and 4)

Referring to FIG. 3, a dot print head in a second embodiment according to the present invention comprises a yoke block 21 and an armature block 22. The yoke block 21 comprises an annular yoke 23, a plurality of cores 24 in an annular arrangement, an annular armature support 24 formed inside the annular arrangement of the cores 24, and solenoid coils 26 wound respectively around the cores 24. The yoke 23, the cores 24 and the armature support 25 are formed integrally in a single unit. The armature block 22 comprises an armature holding member 27, a plurality of armatures 28, an armature guide 29 fixed to the armature holding member 27 so as to holding the armatures 28 for swing motion, a nose 30 formed integrally with the armature guide 29, three stylus guides 31, 32 and 33 fixedly provided within the nose 30, and styluses 34 fixed respectively to the front ends of the armatures 28 and guided by the stylus guides 31, 32 and 33 for sliding movement. The armature guide 29 is provided with a plurality of projections 36, which engage holes 35 formed in the armatures 28, respectively. Outer balancing springs 37 are fitted in recesses formed in the armature guide 29 outside the arrangement of the projections 36 at positions corresponding to the armature support 25, and inner balancing springs 38 are fitted in recesses formed in the armature guide 29 inside the arrangement of the projections 36 to apply pressure to the armatures 28. A pressure applied to the armature 28 by the inner balancing spring 38 is greater than that applied to the same by the outer balancing spring 37, so that the rear end of the armature 28 is separated from the end surface of the corresponding core 24 when the solenoid coil 26 is not energized. Three axial through holes 39 are formed at regular angular intervals in the peripheral portion of the armature holding member 27, three internally threaded holes 40 are formed in the peripheral portion of the yoke 23 so as to correspond to the through holes 39, respectively, and bolts 41 are inserted through the through holes 39 and screwed in the internally threaded holes 41 to fasten the armature holding member 27 to the yoke 23.

An armature stopper 42 is disposed coaxially within the annular yoke 23. The armature stopper 42 consists of an aluminum base plate 43, and a cushion member 44 formed of fluororubber and filling a recess formed in the aluminum base plate 43. The armature stopper 42 is formed by finishing one major surface of the base plate 43 in a flat surface, forming the recess in the flat surface, filling fluororubber in the recess and baking the fluororubber filled in the recess so that the surface of the fluororubber cushion member 44 and the flat surface of the base plate 43 are flush with each other. Three through holes 46 are formed at regular angular intervals in the peripheral portion of the armature holding member 27 to receive adjusting screws 45 therethrough. The extremities of the adjusting screws 45 are screwed in internally threaded holes formed in the base plate 43. Counterbores 48 are formed in the inner ends of the through holes 46, and compression springs 47 are put in the counterbores 48 so as to press the armature stopper 42 away from the armature holding member 27. The heads 45*a* of the adjusting screws 45 are seated on the outer surface of the armature holding member 27. The end surface of the yoke 23 to be in contact with the inner surface of the armature holding member 27, and the end surfaces of the cores 24 are flush with each other. A reference surface 49 facing the armature stopper 28 is formed in the armature holding member 27 and the armature guide 29 so as to be flush with the end surfaces of the cores 24 when the armature holding member 27 and the yoke 23 are joined together.

In positioning the armature stopper 42 relative to the reference surface 49, first the adjusting screws 45 are turned in the screwing direction until the flat surface of the armature stopper 42 is brought into contact with the reference surface 49, which is flush with the end surfaces of the cores 24. Then, the the adjusting screws 45 are turned in the unscrewing direction by the same angle to separate the armature stopper 42 from the reference surface 49 by a predetermined distance, so that the armature stopper 42 is moved in parallel to and away from the reference surface 49 by the pressure of the compression springs 47 to a predetermined position, where the flat surface of the armature stopper 42 facing the reference surface 49 defines a return position for the armatures 28. The greater the gap between the flat surface of the armature stopper 42 and the reference surface 49, the greater is the gap between rear end of each armature 28 and the end surface of the core 24, hence greater is the stroke of the stylus 34. Thus, the position of the armature stopper 42 defining the stroke of the styluses 34 can be easily and accurately determined relative to the reference surface 49 by means of the adjusting screws 45. This positional adjustment of the armature stopper 42 can be carried out either before or after joining together the yoke 23 and the armature holding member 27, which facilitate the adjusting work. The armature stopper 42 can be disposed in the central portion of the yoke 23 because the yoke 23 and the armature holding member 27 are joined together with the bolts 41 along the respective peripheral portions thereof. Accordingly, the rear ends of the styluses 34 can be arranged on a small circle and hence the styluses 34 are bent slightly. Consequently, friction between the styluses 34 and the stylus guides 31, 32 and 33 is comparatively small, the styluses 34 are comparatively short and comparatively lightweight, and hence the dot print head is able to operate at a high printing speed and the armatures 28 can be attracted to the cores 24 by supplying a comparatively small current to the solenoid coils 26.

It is possible to position the armature stopper 42 relative to the reference surface 49 by providing a plurality of adjusting screws on the yoke block 21 in screw engagement, turning the adjusting screws in the screwing direction to press the armature stopper 42 against the reference surface 49 against the pressure of the compression springs 47, and turning the adjusting screws in the unscrewing direction to position the armature stopper 42 relative to the reference surface 49.

It is also possible to position the armature stopper 42 relative to the reference surface 49 by pressing the armature stopper 42 toward the reference surface 49 of the armature holding member 27 with springs, providing a plurality of adjusting screws on the yoke block 21 in screw engagement, connecting the extremities of the adjusting screws to the armature stopper 42 so that the adjusting screws are able to rotate relative to the armature stopper 42 and unable to move axially relative to the armature stopper 42, turning the adjusting screws in the screwing direction to press the armature stopper 42 against the reference surface 49, and turning the adjusting screws by the same angle in the unscrewing direction to pull the armature stopper 42 away from the reference surface 49 by a predetermined distance to position the armature stopper 42 relative to the reference surface 49.

Figure 5:
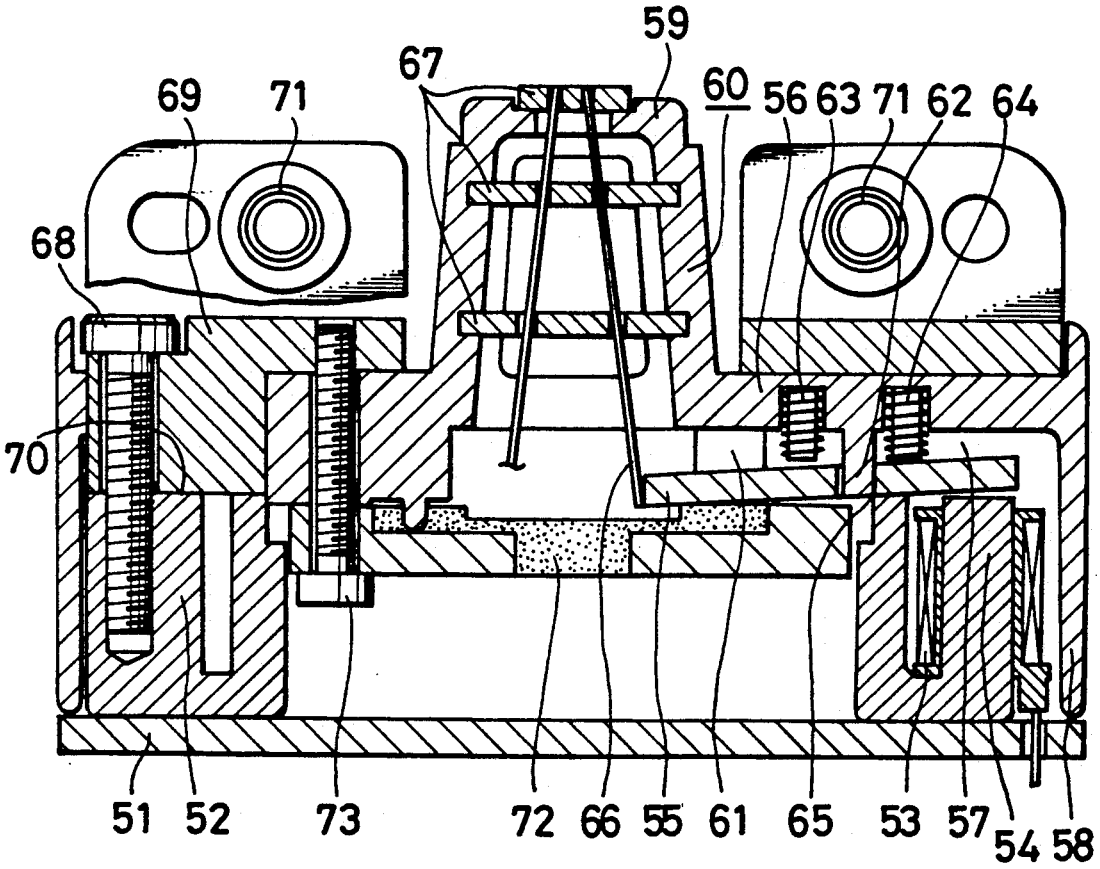
FIG. 5 is a longitudinal sectional view of a dot print head in a third embodiment according to the present invention.
Figure 6:
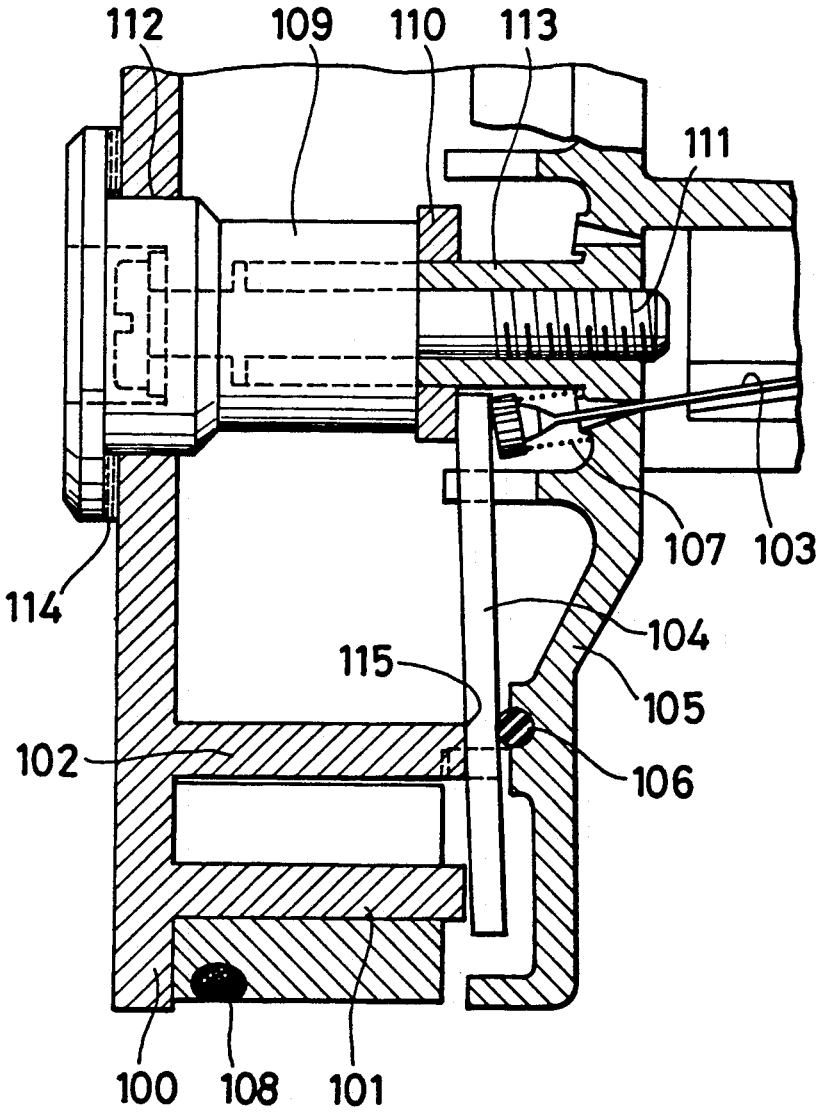
FIG.6 (PRIOR ART)
FIG. 6 is a fragmentary longitudinal sectional view of a conventional dot print head.
Figure 7:
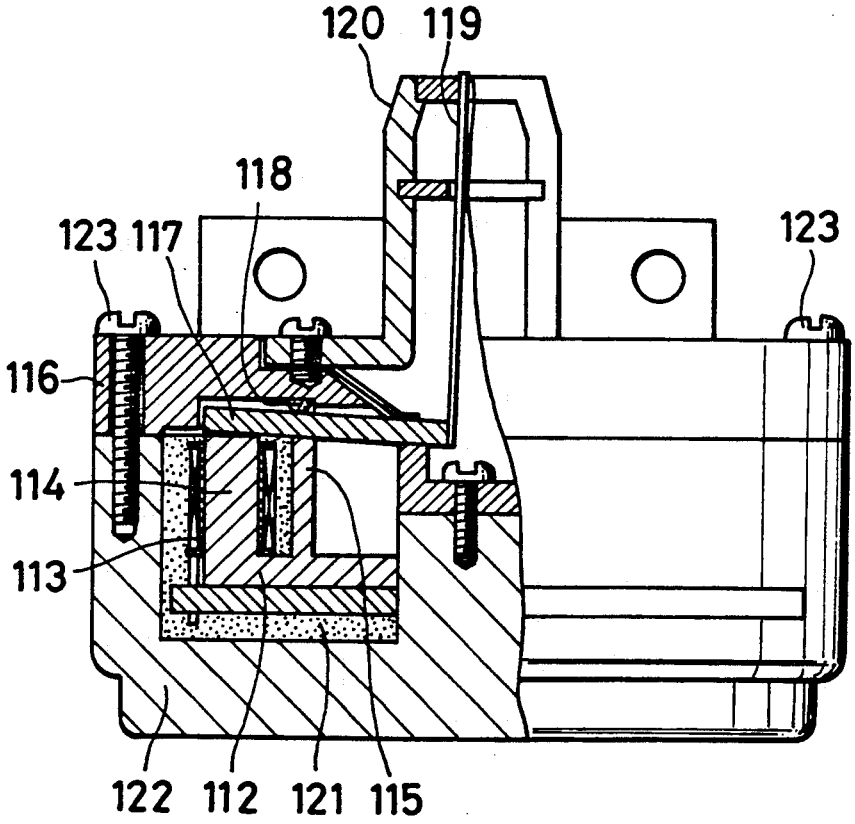
FIG. 7 (PRIOR ART)
FIG. 7 is a partially cutaway side elevation of another conventional dot print head.

Third Embodiment (FIG. 5)

Referring to FIG. 5, An annular yoke 52 is fixed to a PC board 51. A plurality of cores 54 and an armature support 65 having a support edge are formed integrally with the yoke 52 in the peripheral portion of the yoke 52, and solenoid coils 53 are wound respectively around the cores 54. A plurality of armatures are supported for swing motion on the support edge of the armature support 65 opposite to the cores 54, respectively. A protective cover 60 is formed of a synthetic resin. The protective cover 60 has a covering wall 56 covering the armatures 55, an armature guide 57 formed on the inner surface of the covering wall 56, an annular wall 58 surrounding the yoke 52 including the cores 54 and the solenoid coils 53, and a nose 59 protruding from the covering wall toward a platen, not shown. Formed on the armature guide 57 are guide lugs 61 projecting from the inner surface of the covering wall 56 so as to receive the armatures 55 therebetween, round guide pins 62 projecting from the inner surface of the covering wall 56 so as to penetrate the central portions of the armatures 55, respectively, recesses for receiving inner springs 63 for pressing the armatures 55 therein, formed inside the arrangement of the guide pins 62 in the inner surface of the covering wall 56, and recesses for receiving inner springs 64 for pressing the armatures 55 therein, formed outside the arrangement of the guide pins 62 in the inner surface of the covering wall 56. A plurality of stylus guides 67 are provided fixedly within the nose 59 to guide styluses 66 welded respectively to the front ends of the armatures 55 for sliding movement.

A metallic holding member 69 is fastened to the yoke 52 with screws 68 with the contact surface 70 thereof in contact with the yoke 52. The metallic holding member 69 is similar in plan view to the yoke shown in FIG. 2. The metallic holding member 69 has lugs 71 to be fastened to the carriage, not shown, of a printer. The lugs 71 are formed near the extremity of the nose 59. An armature stopper 72 defining the return position of the armatures 55 is fastened to the protective cover 60 with screws 73.

Pressure applied by the inner spring 63 to the armature 55 is greater than pressure applied to the same by the outer spring 64, so that the rear end of the armature 55 is separated from the end surface of the core 54 as shown in FIG. 5 while the corresponding solenoid coil 53 is not energized. When the solenoid 53 is energized, the rear end of the corresponding armature 55 is attracted to the core 54 to turn the armature 55 on the support edge of the armature support 65, so that the stylus 66 is advanced to the platen to print a dot. Heat generated by the solenoid coils 53 when energized is transferred through the cores 54, the yoke 52, the metallic holding member 69, the lugs 71 and the carriage of the printer to the frame of the printer. Since the yoke 52 and the solenoid coils 53 are surrounded by the annular wall 58 of the protective cover 60, the operator is protected from the danger of a burn even if the operator touches the dot print head in changing the ink ribbon after opening the casing of the printer. The annular wall 58 of the protective cover 60 may be provided with a plurality of small holes to promote the diffusion of the heat generated by the solenoid coils 53.

Since the heat generated by the solenoids 53 and heating the yoke 52 can be transferred to the carriage, the annular wall 58 may be formed in a small thickness. Since the annular wall 58, the armature guide 57 and the nose 59 are formed in a single unit, the protective cover 60 has a comparatively small size and the dot print head requires less parts than the conventional dot print head provided with a protective cover.

Furthermore, since the lugs 71 are formed near the extremity of the nose 59, positional error of the lugs 71 on the carriage does not cause significant errors in the position of the extremity of the nose 59 with respect to a correct printing position.

What is claimed is:

1. A dot print head comprising: a yoke having a peripheral portion; a plurality of cores having end surfaces formed integrally with the yoke and arranged in a circumferential ring on the peripheral portion of the yoke; solenoid coils wound respectively around the cores; an armature support having end surfaces formed integrally with the yoke along and inside the circumferential ring of cores; armatures having front, middle, and rear portions each fixedly provided with a stylus at the front portion thereof and supported at the middle portion thereof for swinging motion on the armature support, said armatures being biased so that the respective rear portions thereof are separated from the end surfaces of the corresponding cores while the solenoids coils are not energized; and an armature holding member disposed opposite to the yoke with a predetermined gap therebetween and holding the armatures for swinging motion on the armature support; a plurality of joining parts having contact surfaces located on the circumferential ring of the yoke and a second plurality of joining parts also having contact surfaces located on the armature holding member at positions corresponding respectively to the joining parts located on the yoke and means located on said circumferential ring and passing through said contact surfaces to hold the contact surfaces of said yoke against the contact surfaces of said armature holding member.

2. A dot print head according to claim 1, wherein the contact surfaces of the joining parts of the yoke are flush with the end surfaces of the cores and the armature support.

* * * * *